US005799271A

United States Patent [19]

Byun et al.

[11] Patent Number: 5,799,271

[45] Date of Patent: Aug. 25, 1998

[54] METHOD FOR REDUCING PITCH SEARCH TIME FOR VOCODER

[75] Inventors: Kyung-Jin Byun; Ha-Young Yoo; Jong-Jae Kim; Ki-Chun Han; Jae-Suk Kim, all of Daejeon; Myung-Jin Bae, Seoul, all of Rep. of Korea

[73] Assignee: Electronics and Telecommunications Research Institute, Daejeon, Rep. of Korea

[21] Appl. No.: 670,789

[22] Filed: Jun. 24, 1996

[51] Int. Cl.[6] ..... G10L 9/02

[52] U.S. Cl. ..... 704/217; 704/207; 704/209; 704/268

[58] Field of Search ..... 395/2.09, 2.26, 395/2.3, 2.38, 2.17, 2.16, 2.31, 2.25, 2.28, 2.32; 704/217, 263, 268, 207, 200, 208, 221, 229, 222, 216, 219, 223, 220, 209, 258, 264, 265, 266

[56] References Cited

U.S. PATENT DOCUMENTS

| | | | |
|---|---|---|---|
| 5,426,718 | 6/1995 | Funaki et al. | 395/2.25 |
| 5,457,783 | 10/1995 | Chhatwal | 395/2.28 |
| 5,657,419 | 8/1997 | Yoo et al. | 395/2.32 |

FOREIGN PATENT DOCUMENTS

| | | | |
|---|---|---|---|
| 0476614 | 3/1992 | European Pat. Off. | G10L 9/14 |
| 0596847 | 5/1994 | European Pat. Off. | G10L 9/18 |

OTHER PUBLICATIONS

Proceedings of the IEEE 1995 Custom Integrated Circuits Conference, Yoo et al., "Efficient DSP design for vocoder application," pp. 189–192, May 1995.

*Primary Examiner*—Richemond Dorvil

*Attorney, Agent, or Firm*—Antonelli, Terry, Stout & Kraus, LLP

[57] ABSTRACT

The present invention relates to the method to receive a speech signal, to perform a recognition weighting process on it, to synthesize a synthetic speech signal, to calculate an autocorrelation of the synthetic speech signal whose delay is a predetermined value and an autocorrelation whose delay is 0, to divide the square of the former by the latter, to calculate a pitch lag and a pitch filter coefficient by calculating only the part of a positive peak with skipping over the part of a negative peak by using the results from the dividing operation, and to calculate and output the pitch lag and the pitch filter coefficient by repeating the above process Thus, real-time implementation of CELP vocoder can be achieved.

5 Claims, 3 Drawing Sheets

METHOD FOR REDUCING PITCH SEARCH TIME FOR VOCODER

FIELD OF THE INVENTION

The present invention relates to coding method for a digital cellular phone in telecommunication and more particularly to method for reducing pitch search time for a vocoder.

BACKGROUND OF THE INVENTION

So far, quite a few speech waveform coders have been implemented by using a variety of vocoder theories in order to effectively use the bandwidth of a transmission channel and to obtain high fidelity in digital communication. In general, there are three methods in a vocoder technique for coding a speech signal: waveform coding method, source coding method, and hybrid coding method. The hybrid method is used most popularly as the most preferable method for a vocoder. The hybrid method models a vocal tract filter by utilizing a linear predictive analysis and transmits the remaining residual signals after specially coding them. There are three prediction methods in the hybrid method: RELP (Residual Excited Linear Prediction), VELP (Voice Excited Linear Prediction), and CELP (Code Excited Linear Prediction). It is the CELP that has superior fidelity in comparison with other coding methods which have low transmission rates.

The CELP according to prior art will be described in brief. The CELP vocoder according to prior art comprises an encoding part and a decoding part. The encoding part will be described but not the decoding part, since the decoding part is the reverse process to that of the encoding part. For instance, when a voice is sampled at the rate of 8000 samples per second and input to the CELP vocoder, the CELP vocoder processes the speech signal frame by frame. One frame is made up of 160 samples (=20 ms). In other words, the CELP vocoder receives a speech signal of a frame(=160 samples) and obtains 10 LPC (Linear Prediction Code) coefficients and then it converts them to LSP (Line Spectral Pair) frequency which is immune against errors of quantization. Next, the CELP vocoder performs a pitch searching process and a codebook searching process. The pitch searching process is performed one time over a speech signal of 5 ms (=40 samples) in order to keep the sound quality from lowering. So, four pitch searching processes are performed over one frame. The pitch searching process finds a pitch lag and a pitch filter coefficient that make minimal errors by synthesizing a synthetic speech signal and comparing it to the input speech signal. The synthetic signal synthesizing process requires the process that interpolates linearly the LSP frequency of one frame (=20 ms) over each frame of 5 ms and converts it to the LPC coefficient. The LSP frequency of one frame was obtained previously. Finally, the CELP vocoder eliminates formant components and pitch components from the speech signal and looks for a codebook corresponding to the information on the remaining residue signals. Here, the codebook having the minimum comparison error is found by the method comparing the input signal with the synthetic signal synthesized by the codebook. As described above, when pitch lag (L), pitch filter coefficient (b), codebook index (I), codebook gain (G), and LSP frequency obtained from the speech signal of 160 samples (=20 ms) are made into data of 160 bits, a speech signal can be transmitted at the rate of 8 Kbps.

The first step of the method described above is calculating the pitch lag L 128 times over a closed loop and synthesizing a synthetic signal and, further, increasing the value of a pitch lag L from 20 to 147 one by one. After that, by comparing the original speech signal with the synthetic signal, the pitch lag L is set to be the value that makes the minimum error. The second step is calculating the correlation E(.) as follows in terms of time delay for the residue signal s(.) in pitch searching process:

$$E(L)=\frac{\sum_{n=0}^{N_h-1} s(n)s(n-L)}{\sum_{n=0}^{N_h-1} s(n)s(n)} \tag{1}$$

where $N_h$ stands for the length of subframe; and L stands for pitch search interval as pitch lag.

A correlation E(L) is obtained to be approximately 1 every pitch period. How similar the pieces of wave in the periods are depends on the periodicity of a wave in the interval of pitch searching and the variation of the amplitude of the wave. In the case of the vocal sound whose periodicity of pitch is very strong, the value is usually 0.9~1.1 and varies very slowly for time delay. In order to obtain the most preferred pitch lag in pitch searching, such an expression of correlation as the expression (1) has to be applied to all pitch lags with as much repetition as possible. It requires a very massive amount of $2N_h$ addition operations and $2N_h$ multiplication operations for every pitch lag L, whose range is from 20 to 147 samples. Therefore, the calculation time for pitch searching process is more than half of the entire vocoder calculation time, although a CELP vocoder is implemented with the most recent integer-type DSP chip. Thus, there is required an algorithm to reduce pitch search time while further keeping pitch search error to a minimum.

As described above, CELP method is a method of analysis by synthesis. The fidelity of the synthesized speech signal has to be so good even at a low transmission rate that the vocoder is required to have a very complex structure and perform a massive amount of arithmetic operations.

The part which requires the most massive amount of arithmetic operations in CELP vocoder includes the process to find the input excitation signal from the codebook and the process to find a pitch filter coefficient. The pitch filter coefficient can be found through pitch searching process. More than 50% of the entire calculation of CELP vocoder belongs to the pitch searching process in which the information on the pitch period of a long term auto-correlation of a speech signal is obtained. An improvement in this pitch search part results in a great improvement of performance of an overall vocoder.

The fidelity of a synthetic speech signal gets lower fast when the pitch search interval increases above a predetermined limit. So, a pitch search interval is, in general, set to be 5 ms–10 ms in order to minimize the amount of arithmetic operations and to avoid fidelity deterioration of a synthetic speech signal. When a pitch lag (L) and a pitch filter coefficient (b), the parameters of the pitch filter for a speech signal sampled at 8KHz, are obtained, a closed loop structure is usually utilized to provide excellent fidelity. In the closed loop structure, a pitch lag is limited within the range from 20 to 147. A pitch filter coefficient is found for the 128 pitch lag values limited in that range and the response of a pitch filter is obtained for a residual signal of a spectrum filter by use of the pitch filter coefficient. When L and b are obtained by calculating mean square error of the residual signals for each case, the optimal pitch filter its determined. The arithmetic operations for a closed loop are always repeated 128 to find the optimal pitch lag value and the gain. A massive amount of arithmetic operations is required to find a parameter. So CELP vocoder should have a very complex structure to perform such a massive amount of arithmetic operations. In addition, it is very difficult to achieve real-time implementation of CELP without a high speed DSP chip.

SUMMARY OF THE INVENTION

It is, therefore, an object of the present invention to provide a method to provide an improved pitch search using positive autocorrelation and to provide easy real-time implementation.

It is a further object of the present invention to equip a DSP chip with other functions due to a reduced amount of arithmetic operations thereby.

The present invention is a method for reducing pitch search time for CELP vocoder. The method comprises the following steps. The first step is receiving a speech signal and removing ZIR (Zero Input Response) of a formant synthesizing filter from the speech signal. The second step is performing a recognition weighting process on the ZIR-free speech signal and assuming a pitch lag to be a predetermined value. The third step is synthesizing a synthetic speech signal by passing the remaining formant components of the input speech signal of a present frame and an output signal of a pitch filter of a prior frame through a weighting filter. The fourth step is calculating an autocorrelation of the synthetic speech signal whose delay is a predetermined value and an autocorrelation whose delay is 0, and dividing the square of the autocorrelation whose delay is a predetermined value by the autocorrelation whose delay is 0. The fifth step is calculating a pitch lag and a pitch filter coefficient by calculating only the part of a positive peak, skipping over the part of a negative peak by using the results from the fourth step. The sixth step is determining whether a total lag to be considered to be of a positive peak is greater than a predetermined value. The seventh step is determining whether the pitch lag is greater than a predetermined value, if it is determined that the total lag to be considered to be of a positive peak is not greater than a predetermined value at the sixth step. The eighth step is rendering the program to return to the third step if it is determined that the pitch lag is not greater than a predetermined value at the seventh step. The last step is outputting the pitch lag and the pitch filter coefficient and terminating the program if it is determined that the pitch lag is greater than a predetermined value at the sixth step or if it is determined that the pitch lag is greater than a predetermined value at the seventh step.

BRIEF DESCRIPTION OF THE DRAWINGS

The above and other objects, features and advantages of the present invention will become more apparent from the following description taken in conjunction with the accompanying drawings in which like reference characters designate like or corresponding parts throughout the several views, and wherein.

Figure 1:
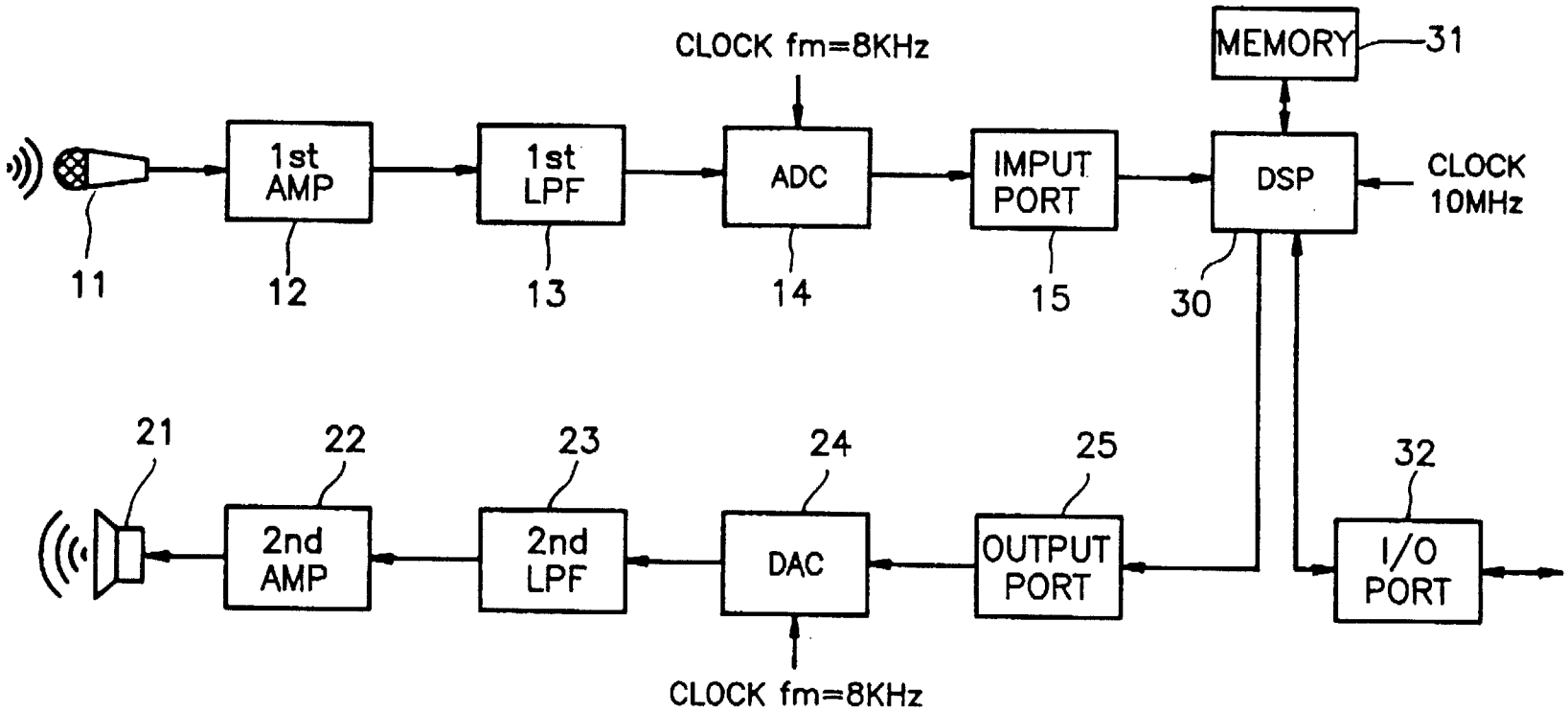
FIG. 1 is a block diagram of an exemplary hardware configuration for implementing the present invention.

DETAILED DESCRIPTION OF THE INVENTION $$E(L) = \frac{\sum_{n=0}^{N_h-1} s(n)s(n-L)}{\sum_{n=0}^{N_h-1} s(n)s(n)}$$

where $N_h$ stand for the length of subframe: and L stands for pitch search interval as pitch lag.

Calculating the correlation of speech wave by using the formula (1), it can be found that the waveform has the following characteristics.

The first characteristic is slow variation. In the speech wave, the correlation of neighborhood samples is so high that the correlation peak varies very slowly. The correlation peak represents the relationship between neighborhood samples.

The second characteristic is peak width. In the vocal sound wave, the wave in the interval as long as a pitch period oscillates with the period of a first formant with attenuation, since the energy of the first formant is larger than those of other formants. An autocorrelation waveform keeps its period to be the period of the first formant. The correlation waveform makes a predetermined width in pitch periods.

The third characteristic is negative peaks. A speech wave alternates positive peaks and negative peaks to form one pitch period. When correlation is calculated based on positive peaks of the waveform, a positive value is obtained for every positive peak. When correlation is calculated based on negative peaks of the waveform, a positive value is obtained for every negative peak. Accordingly, a correlation waveform alternates positive peak and negative peak depending on time delay.

Therefore, it is reasonable to consider only the case in which the correlation applied to pitch searching makes positive peaks, since the pitch lag making the maximum correlation in pitch searching is considered to be a pitch period. That the correlation waveform alternates a positive peak and a negative peak is illustrated as follows. When a positive peak caused by the pitch lag appears, in the next interval, a negative peak whose width is as wide as that of a positive peak exists. And so, the correlation does not have to be calculated in that interval. That is, if a positive correlation is being calculated and this interval is being measured by $L_c$ counter, when E(L) is found to be below 0, the pitch lag interval to be searched next is as follows:

$$L \leftarrow L + L_c \times d \text{ samples} \quad (2)$$

where d is skip ratio to determine the width of a negative peak skipped result from comparing to the width of a positive peak.

The pitch search interval decreases as this value increases, but as shown in table 1, if d gets above 1.5, a predictive gain diminishes so rapidly that it is undesirable.

TABLE 1

Search time ratio and predictive gain of pitch filter according to skip ratios

| | Skip Ratios | | | | | |
|---|---|---|---|---|---|---|
| | 1.0 | 1.2 | 1.3 | 1.4 | 1.5 | 2.0 |
| pitch filter coefficient (dB) | 11.63 | 11.60 | 11.28 | 10.61 | 9.75 | 8.05 |
| search time (%) | 77.2 | 70.9 | 68.9 | 67.5 | 66.7 | 63.6 |

Accordingly, it is most preferable that d is about 1.2. 40% or more of calculation time can be saved when vocal sounds are searched since the symmetry of correlation of vocal sounds can be used as described above, but no calculation time can be saved when voiceless sounds and silent sounds are searched since all values of correlation of voiceless sounds and silent sounds are positive or negative. That is, in the case described above, calculation time cannot be saved in comparison with an entire pitch search. Pitch searching interval can be set arbitrarily and it does not have to be set for an entire interval since there is no periodicity in that case. In the case of vocal sound, $L_i$ does not have to be above half of an entire search interval (20 samples–148 samples), if the values of correlation are symmetric around the level of 0. In addition, considering that the negative peak is skipped over as much as the skip width of d—1.2 times the width of the positive peak, the total number of delay regarded as that of positive peak is as follows:

$$L_t = \frac{148 - 20}{d + 1} = 58 \text{ samples}$$

If a pitch search interval is limited in the interval in which the correlation is considered to be positive, pitch search time is reduced as follows in comparison with entire search time:

$$T_d = \frac{58}{128} \times 1.05 \times 100 = 47.6\%$$

In the above expression, 105% is multiplied in order to include the time additionally required to calculate positive correlation.

To find the time difference between two pitch search procedures, average pitch search times are obtained in terms of one second for each procedure.

TABLE 2

Pitch search time, pitch filter coefficient, and deterioration claissified by pitch searching lag samples

| | Pitch Searching Lags (samples) | | | | | |
|---|---|---|---|---|---|---|
| | 74 | 64 | 58 | 50 | 40 | 30 |
| search time (%) | 60.7 | 52.5 | 47.6 | 41.0 | 32.8 | 24.6 |
| pitch filter coefficient (dB) | 11.63 | 11.58 | 11.48 | 11.32 | 10.50 | 8.50 |
| deterioration (dB) | 0.1 | 0.15 | 0.25 | 0.41 | 1.16 | 3.23 |

Table 2 illustrates gains of pitch filters classified by processing time in order to compare the pitch search procedure proposed by this invention with the pitch search procedure of the prior art. Average gains of a pitch filter deteriorate as much as 0.1, 0.15, 0.25, 0.41, 1.16, and 3.23 dB respectively, when respectively reduced 74, 64, 58, 50, 40, and 30 are the pitch search intervals considered to be positive count for serial pitch search (L=128 intervals) of the prior art.

Considering only positive correlation for serial pitch search, deterioration of average gain of a pitch filter can be negligible although it is deteriorated by as much as 0.5 dB. Applying the method proposed by this invention to an actual speech signal having fifty samples per a pitch search interval, a pitch filter coefficient is reduced as much as 0.41 dB. And thus, calculation time can be reduced as much as about 59%.

DESCRIPTION OF THE PREFERRED EMBODIMENT

As shown in FIG. 1, there is illustrated an exemplary hardware configuration for implementing the present invention. This embodiment has the same structure as that of general speech signal processing systems.

An acoustic wave signal is transformed into an electric signal by the microphone 11 and a transformed electric signal is amplified up to a predetermined level by the first amplifier 12. For a speech signal, the signal input through the microphone 11 consists of the components whose frequencies are 20 Hz–20 KHz. In this invention, it is sufficient only to process the components of message transfer information. The first LPF (Low Pass Filter) 13 filters off the other components outside the range of 0 KHz—4 KHz from the amplified signal. In fact, speech signals below 3.4 KHz are transmitted in telecommunication. The first LPF (Low Pass Filter) 13 passes only the components in the range of the message transfer information within 4 KHz in order to reduce the amount of data to be processed in a second for when a speech signal has been transformed into a digital signal. The low-pass filtered analog signal below 4 KHz has to be transformed into a digital signal in order to be processed by a computer. The low-pass filtered analog signal below 4 KHz is sampled and transformed into digital signal by the ADC (Analog to Digital Converter) 14. The sampling frequency at which an analog signal is sampled into a digital signal has to be double of the highest frequency of the bandlimited analog signal according to Nyquist sampling theory. In this embodiment, the sampling rate is 8 KHz, since the highest frequency is 4 KHz.

The sampled signal has to be quantized and the number of quantization levels is 4096 (=$2^{12}$12 bits) levels using 12 bits based on telephone fidelity. The digital speech signal processed in such a way as described above is input to the input port 15 to be calculated and processed in a DSP 30 with a microprocessor. The input speech signal data is processed through software procedures and stored in the memory 31 or output to the I/O (Input/Output) port 32 to be transmitted through a transmission channel if necessary. If necessary, the DSP 30 synthesizes a digital speech signal by utilizing decoding procedures using the data read out from the memory 31 or the data input through the transmission channel. The synthetic speech signal on which the decoding procedure has been completed is transferred to the output port 25 in order to be heard through the speaker 22. The data is transferred to the output port 25 and the data is transferred to the DAC (Digital to Analog Converter) 24. In this case, the digital signal is transformed into an analog signal with the sampling rate of 8 KHz. The transformed signal is low-pass filtered by the second LPF (Low Pass Filter) 23 and the components outside baseband is eliminated since harmonic components due to sampling rate are included in the transformed signal. The low-pass filtered analog signal is amplified by the second amplifier 22 so that it is supplied to the speaker 21 and can drive the speaker 21. The speaker 21 transforms the signal into a sound pressure wave so that human ears can hear the sound.

Figure 2A:
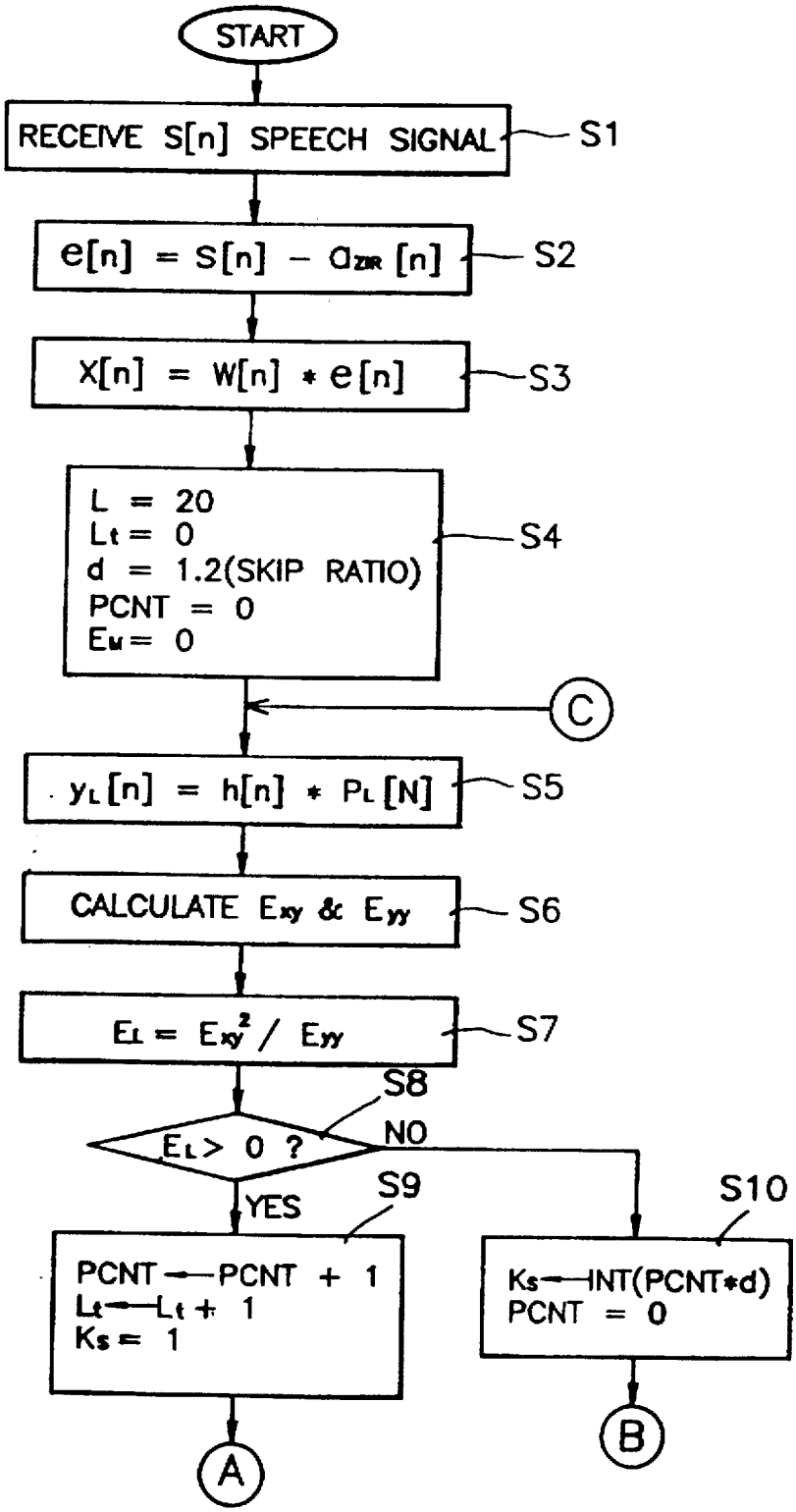
FIG. 2A–2B are a flowchart of a software process for implementing the pitch search method of the present invention.
Figure 2B:
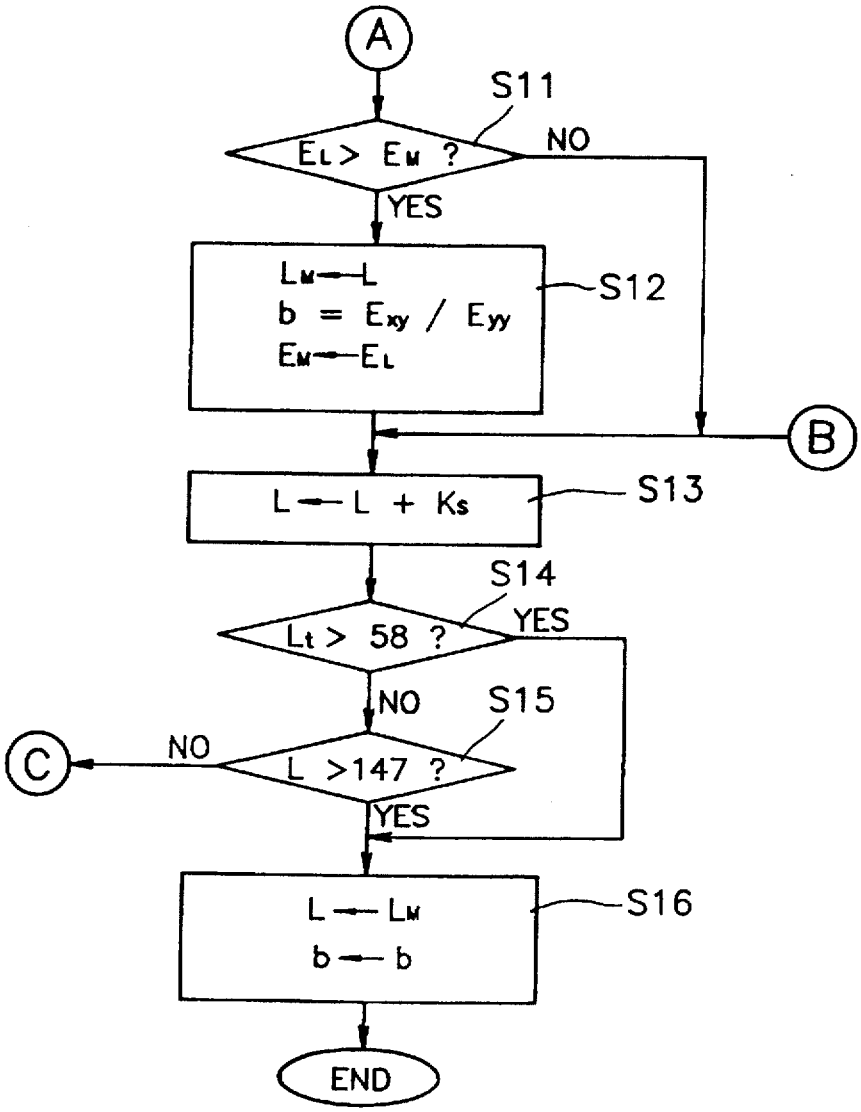

FIG. 2A–2B is a flowchart of a software process for implementing pitch search method of the present invention.

A general pitch searching method is the method to compare an input speech signal to a synthetic signal and find the pitch lag having the minimum error.

Referring to FIG. 2A–2B, a pitch searching method will be illustrated as follows.

A speech signal s(n) is received as shown by a block S1. Here, ZIR(Zero Input Response) remaining in a formant synthesizing filter can get mixed into s(n) while receiving s(n) in the block S1 due to the result of a prior procedure or due to the undesired initial state of a formant synthesizing filter. The frequency response of the format synthesizing filter is as follows:

$$F(z)=\frac{1}{A(z)}$$

where, $$A(z)=1-\sum_{i=1}^{10}\alpha_i z^{-i}$$

That is, the ZIR of the formant synthesizing filter can be included in s(n). In a block S2, s(n) is subtracted by $a_{zir}(n)$ as follows:

$$e(n)=S(n)-a_{zir}(n)$$

In block S3, the signal e(n) passes through a recognition weighting filter as follows:

$$\text{where, } \begin{cases} w(n)=Z^{-1}\{W(z)\} \\ W(z)=\dfrac{A(z)}{A(z/\alpha)} \end{cases}$$

In the block S4, initial values are set as follows.

Pitch lag time L=20 samples,

Total number $L_t$ of lags to be considered to belong to positive peak=0 samples, Skip ratio d=1.2;

Positive count PCNT=0;

Temporary variable $E_M$=0

In a block S5, the formant remaining components of input speech signal of the present frame and the output signal of a pitch filter of the prior frame pass through a weighting filter and are synthesized into a synthetic speech signal $Y_L(n)$ as follows:

$$y_L(n)=h(n)*p_L(n)=\sum_{i=0}^{\min(n,N_h-1)} h(i)p_L(n-i)$$

$$\text{where } \begin{cases} p_L(n) \text{ is an output signal of a pithch filter.} \\ 0 \leqq n < L_p,\ L_p \text{ is the length of } p_L(n) \\ h[n]=Z^{-1}(H(z)) \\ H(z)=\dfrac{1}{A(z)}\quad w(z)=-\dfrac{1}{A(z/\alpha)} \\ H(z) \text{ is a weighting filter.} \end{cases}$$

In a block S6, $E_{xy}$ autocorrelation whose delay is L and $E_{yy}$ autocorrelation whose delay is 0 are calculated as follows:

$$\begin{cases} E_{xy} = \sum_{n=0}^{L_p-1} x(n)y_L(n) \\ E_{yy} = \sum_{n=0}^{L_p-1} y_L^2(n) \end{cases}$$

In a block S7, the square of $E_{xy}$ is divided by $E_{yy}$ as follows:

$$E_L=\frac{E_{xy}^2}{E_{yy}}$$

It is determined whether $E_L$ is greater than 0, as shown in block S8.

If it is determined that $E_L$ is greater than 0 in block S8, PCNT and $L_1$ are incremented by 1 respectively and temporary variable $K_s$ is initialized to be 1 as shown in block S9.

It is determined whether $E_L$ is greater than $E_M$, as shown in block S11.

If it is determined that $E_L$ is greater than $E_M$ in block S11, $E_M$ is set to be $E_1$ and temporary variable $L_M$ is initialized to be pitch lag time L and pitch filter coefficient b is calculated as follows in block S12:

$$b=\frac{E_{xy}}{E_{yy}}$$

If it is determined that $E_L$ is less than or equal to 0 in block S8, a temporary variable $K_s$ is initialized to be the integer part of PCNT times d and PCNT is set to be 0 as follows in block S10.

$$\begin{cases} K_S \leftarrow INT(PCNT\times d) \\ PCNT=0 \end{cases}$$

If it is determined that $E_L$ is less than or equal to $E_M$ in block S11, or after performing the step in block S10 or block S12, pitch lag time L is incremented as much as a temporary variable $K_s$ as shown in a block S13.

It is determined whether the total number of lag $L_t$ considered to be of positive peak is greater than 58 as shown in block S14.

If it is determined that the total number of lag $L_t$ considered to be of positive peak is not greater than 58 in block S14, it is determined that the pitch lag time L is greater than 147 as shown in block S15.

If it is determined that pitch lag time L is greater than 147 in block S15, or if it is determined that total number of lag $L_t$ considered to be of positive peak is greater than 58 in block S14, pitch lag time L is set to be a temporary variable $L_M$ and pitch filter coefficient b is set to be the present b again and terminated the program. If it is determined that pitch lag time L is not greater than 147 in block S15, the program goes to the block S5.

As described above, in accordance with the present invention, positive peaks of correlation of speech signal and intervals of a predetermined ratio are considered to be negative peaks, and pitch search is not performed but is skipped over. So, when CELP vocoder is implemented, calculation time can save over 26% in overall vocoder processing. And so, real-time implementation of CELP vocoder can be achieved with a slow and cheap DSP chip. Further, an economical CELP vocoder system can be designed since other service functions can be substituted for a reduced amount of arithmetic operation. The present invention prolongs the using time of compact vocoder since the less processing time of a vocoder can reduce amount of consumed power. The present invention can strengthen the competitiveness of commodities.

Although the present invention and its advantages have been described in detail, it should be understood that various changes, substitutions and alterations can be made herein without departing from the spirit and scope of the invention as defined by the appended claims.

What is claimed is:

1. A method for reducing pitch search time for a CELP vocoder, said method comprising the steps of:

(a) receiving a speech signal and removing ZIR(Zero Input Response) of a formant synthesizing filter from the speech signal;

(b) performing a recognition weighting process on the ZIR-free speech signal and assuming a pitch lag to be a predetermined value;

(c) synthesizing a synthetic speech signal by passing remaining formant components of said input speech signal of a present frame and an output signal of a pitch filter of a prior frame through a weighting filter;

(d) calculating an autocorrelation of the synthetic speech signal whose delay is a predetermined value and an autocorrelation whose delay is 0 and dividing the square of the autocorrelation whose delay is a predetermined value by the autocorrelation whose delay is 0;

(e) calculating a pitch lag and a pitch filter coefficient by calculating only a positive peak by skipping over a negative peak by using the results from said step (d);

(f) determining whether a total number of lag to be considered to be of a positive peak is greater than a predetermined value;

(g) determining whether the pitch lag is greater than a predetermined value, if it is determined that the total number of lag to be considered a positive peak is not greater than a predetermined value at said step (f);

(h) returning to said step (c), if it is determined that the pitch lag is not greater than a predetermined value at said step (g); and (i) outputting the pitch lag and the pitch filter coefficient, if it is determined that the pitch lag is greater than a predetermined value at said step (f) or if it is determined that the pitch lag is greater than a predetermined value at said step (g).

2. A method for reducing pitch search time for vocoder as set forth in claim 1, wherein said pitch lag is 20 at said step (b).

3. A method for reducing pitch search time for vocoder as set forth in claim 1, wherein a negative peak is skipped over as much as a product of a skip ratio times a lag interval of a positive peak at said step (e).

4. A method for reducing pitch search time for vocoder as set forth in claim 1, wherein it is determined whether said total number of lag to be considered to be of a positive peak is greater than 58 at said step (f).

5. A method for reducing pitch search time for vocoder as set forth in claim 1, wherein it is determined whether said pitch lag is greater than 147 at said step (g).

* * * * *